US010934750B2

(12) United States Patent
McDonough

(10) Patent No.: US 10,934,750 B2
(45) Date of Patent: Mar. 2, 2021

(54) DETACHABLE DEVICE FOR INHIBITING AIR LEAKS BETWEEN SLIDING PANELS

(71) Applicant: Sean McDonough, Salem, NH (US)

(72) Inventor: Sean McDonough, Salem, NH (US)

( * ) Notice: Subject to any disclaimer, the term of this patent is extended or adjusted under 35 U.S.C. 154(b) by 0 days.

(21) Appl. No.: 16/580,557

(22) Filed: Sep. 24, 2019

(65) Prior Publication Data

US 2020/0095823 A1 Mar. 26, 2020

Related U.S. Application Data

(60) Provisional application No. 62/735,312, filed on Sep. 24, 2018.

(51) Int. Cl.

| | |
|---|---|
| ***E05C 19/18*** | (2006.01) |
| ***E06B 3/54*** | (2006.01) |
| ***E06B 3/263*** | (2006.01) |
| ***E05C 7/00*** | (2006.01) |

(52) U.S. Cl.

CPC ..... *E05C 19/188* (2013.01); *E05C 7/005* (2013.01); *E06B 3/26347* (2013.01); *E06B 3/5481* (2013.01)

(58) Field of Classification Search

CPC .. E06B 3/26347; E06B 3/5481; Y10T 292/34; F16B 47/00; F16B 47/006; E05C 19/188; E05C 19/00; E05C 2007/007

See application file for complete search history.

(56) References Cited

U.S. PATENT DOCUMENTS

| | | | | |
|---|---|---|---|---|
| 1,178,356 | A * | 4/1916 | Stevens | E05C 19/18 292/288 |
| 1,288,231 | A * | 12/1918 | Seglem | F16B 47/00 248/205.7 |
| 5,971,450 | A * | 10/1999 | Suarez | E05B 65/0888 292/289 |
| 6,308,923 | B1 * | 10/2001 | Howard | F16B 47/00 248/205.5 |
| 6,550,735 | B1 * | 4/2003 | Zheng | F16B 47/00 248/205.5 |
| 2004/0124325 | A1 * | 7/2004 | Kwok | F16B 47/006 248/205.8 |
| 2005/0151382 | A1 * | 7/2005 | Barber | E05C 17/525 292/288 |
| 2009/0224117 | A1 * | 9/2009 | Kaneda | F16B 47/00 248/206.3 |
| 2011/0175374 | A1 * | 7/2011 | Hertrich | E05B 65/0014 292/195 |
| 2012/0247022 | A1 * | 10/2012 | McDonough | E06B 3/26347 49/370 |
| 2016/0340948 | A1 * | 11/2016 | McCullough | E05B 65/0014 |
| 2018/0347236 | A1 * | 12/2018 | Smith | E05C 17/525 |

* cited by examiner

*Primary Examiner* — Jessie T Fonseca

(74) *Attorney, Agent, or Firm* — Brian M. Dingman; Dingman IP Law, PC

(57) ABSTRACT

A panel fastening device that is configured to move together a first frame of a first panel unit having a first glass panel mounted within the first frame and a second frame of a second panel unit having a second glass panel mounted within the second frame. The device includes a suction cup is configured to be coupled to and released from the first glass panel of the first panel unit, and a structure is configured to be pressed against and released from the second frame of the second panel unit.

13 Claims, 5 Drawing Sheets

DETACHABLE DEVICE FOR INHIBITING AIR LEAKS BETWEEN SLIDING PANELS

CROSS-REFERENCE TO RELATED APPLICATION

This application claims the priority of Provisional Application 62/735,312 filed on Sep. 24, 2018, the entire disclosure of which is incorporated herein by reference.

FIELD

This disclosure relates generally to sliding panels such as sliding glass doors and windows, and more particularly to a detachable device that pulls two overlapping frames of sliding panels together to help prevent air from leaking between the frames.

BACKGROUND

Sliding panel assemblies for buildings may include sliding glass doors and windows. Each includes a frame with a glass panel mounted within the frame. One or both of the frames may be capable of sliding in a respective wall structure or frame. For instance, a sliding glass door assembly may include a fixed door and a sliding door, both mounted within a wall frame.

These sliding panel assemblies may be subject to great temperature differentials between interior and exterior temperatures, especially in cold weather climates. In addition, differing materials used for the glass panel frames may have different coefficients of thermal expansion causing stress between such materials as they contract and expand at different rates. Such temperature stresses, as well as other problems such as installation defects and normal wear and tear, may cause an air gap to form between the two glass panel frames when the sliding panel assembly is in a closed position. This air gap leads to undesirable heat transfer and substantial heat loss in cold climates.

One conventional method of alleviating such heat loss is to position plastic shrink wrap about the glass panel frames and then fill the air gap between the shrink wrap and the sliding panels with warm air. A drawback with this conventional method is that there is no access to the sliding panel assemblies for regular use once the shrink wrap is in position. For example, a sliding glass door would be inaccessible for entry and exit.

Another conventional method of alleviating heat loss is in material selection and design for the sliding panel frames. Such panel frames may be fabricated of different extruded materials where hollow cavities can be formed to further define air pockets that act as insulation. Although effective, a home owner would need to purchase an entire sliding panel assembly and install the same to enjoy the benefits of such frames.

Yet another conventional method of alleviating heat loss when the sliding panels include sliding glass doors is to install a complex lock mechanism within an existing sliding glass door assembly. In addition to providing for security against intruders, the lock mechanism also provides a means for minimizing heat loss by drawing the door frames together. However, a drawback of this mechanism is the complexity and cost associated with retrofitting an existing sliding door assembly with such a lock mechanism. In addition, tools would be necessary to bore a hole through each door frame and to properly align, secure, and assemble the locking mechanism therein.

Accordingly, it is desirable to provide a detachable device for sliding panels which overcomes the above-described inadequacies and shortcomings.

SUMMARY

A panel fastening device that is configured to move together a first frame of a first panel unit having a first glass panel mounted within the first frame and a second frame of a second panel unit having a second glass panel mounted within the second frame. In one example, the device includes a suction cup that is configured to be coupled to and released from the first glass panel of one panel unit, and a structure that is configured to be pressed against and released from the frame of the other panel unit. The structure that is configured to be pressed against and released from the frame of the other panel unit may comprise an end of a frame clip that is configured to be moved along a threaded rod by an overlying structure. The overlying structure may comprise a handle that is threadably engaged with the threaded rod. The handle may be configured to be pivoted relative to the frame clip. The handle may have a cam surface that sits against a top surface of the frame clip, such that when the handle is pivoted in one direction the cam surface of the handle pushes down against the top surface of the frame clip, to push the frame clip down toward the frame.

The present disclosure will now be described in more detail with reference to exemplary embodiments as shown in the accompanying drawings. While the present disclosure is described below with reference to exemplary embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

For a better understanding of the present disclosure, reference is made to the accompanying drawings, in which like elements are referenced with like numerals, and in which.

DETAILED DESCRIPTION

Figure 1A:
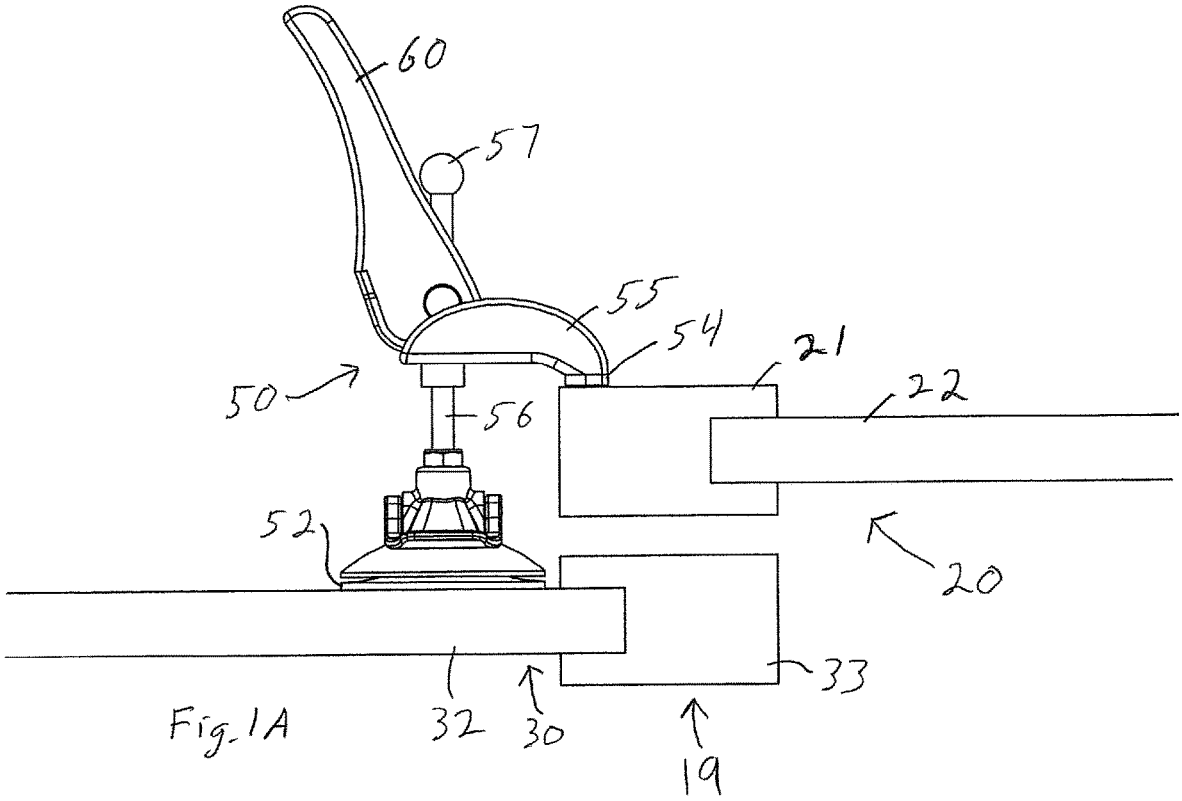
FIGS. 1A and 1B are side views of a detachable device for inhibiting air leaks between sliding panels in the disengaged and engaged positions, respectively.
Figure 1B:
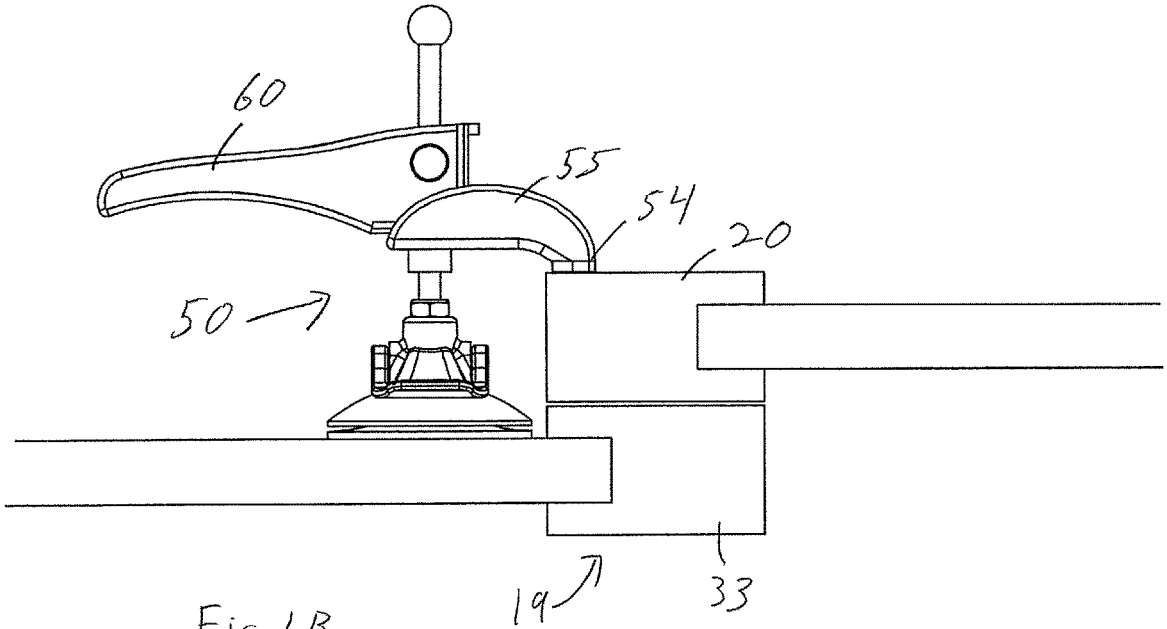
Figure 2:
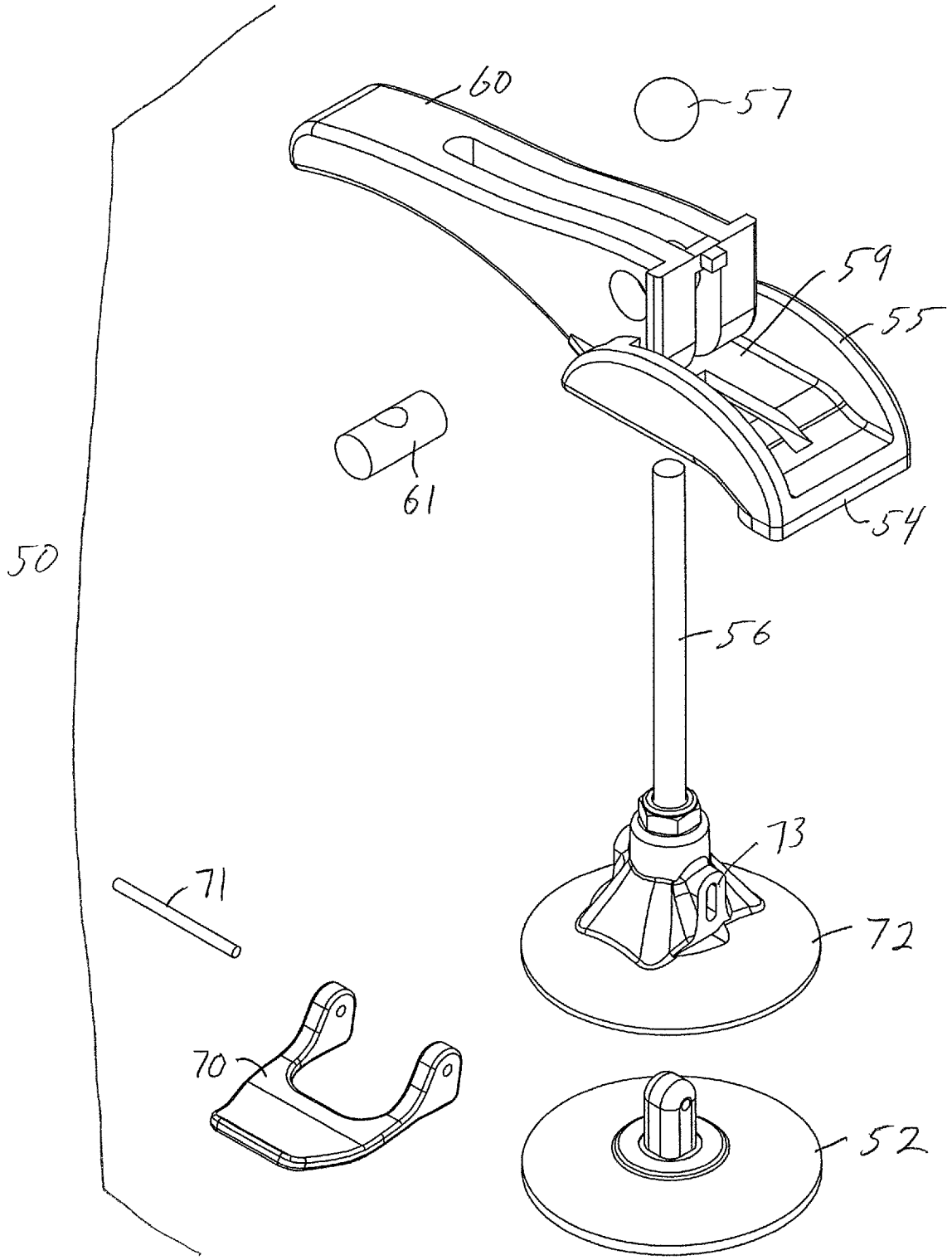
FIG. 2 is an exploded view of the detachable device for inhibiting air leaks between sliding panels of FIGS. 1A and 1B.
Figure 3:
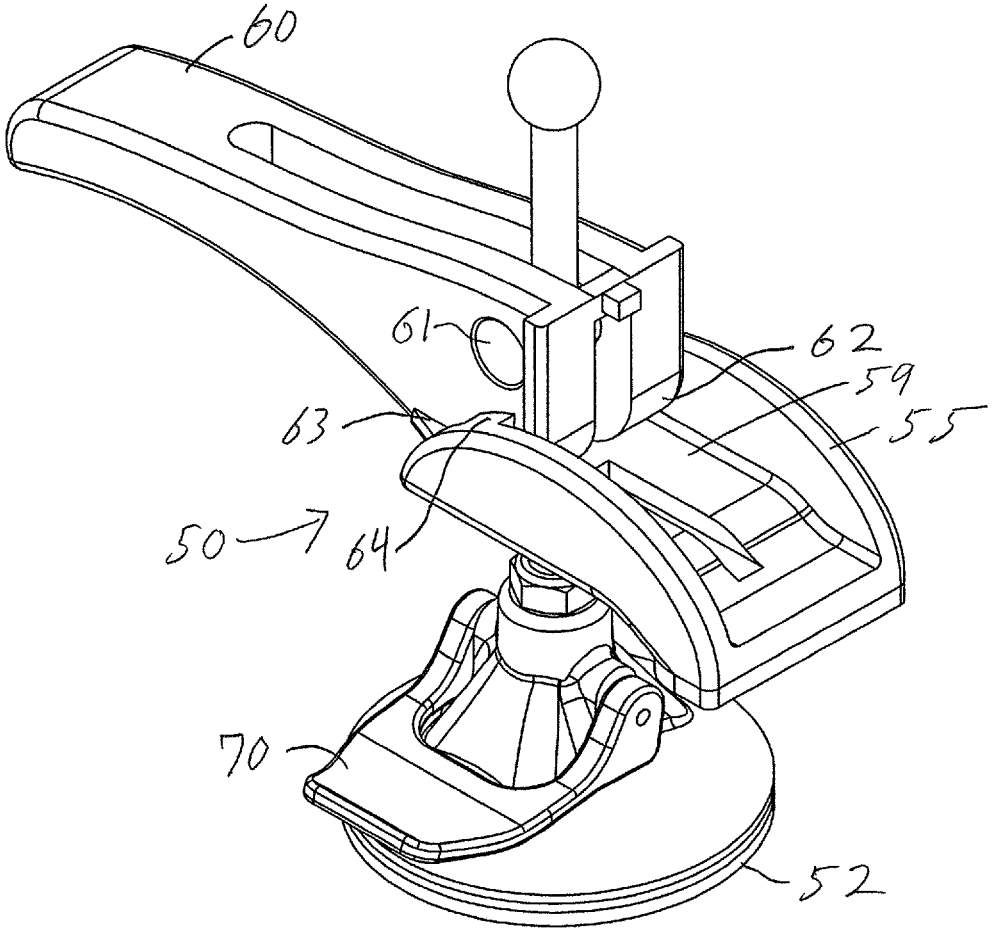
FIG. 3 is a perspective view of the detachable device for inhibiting air leaks between sliding panels of FIGS. 1A, 1B, and 2.
Figure 4A:
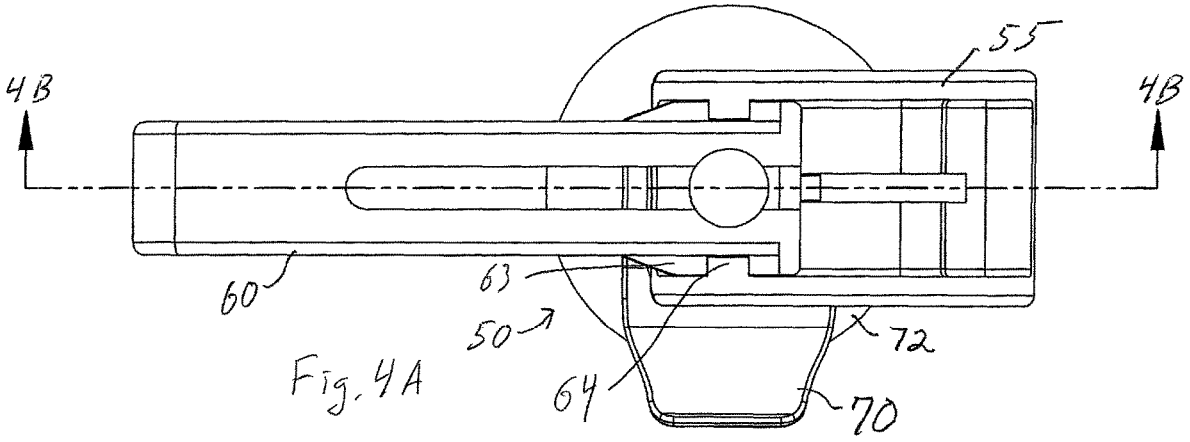
FIGS. 4A is a top view of the detachable device for inhibiting air leaks between sliding panels of FIGS. 1A, 1B, 2, and 3.
Figure 4B:
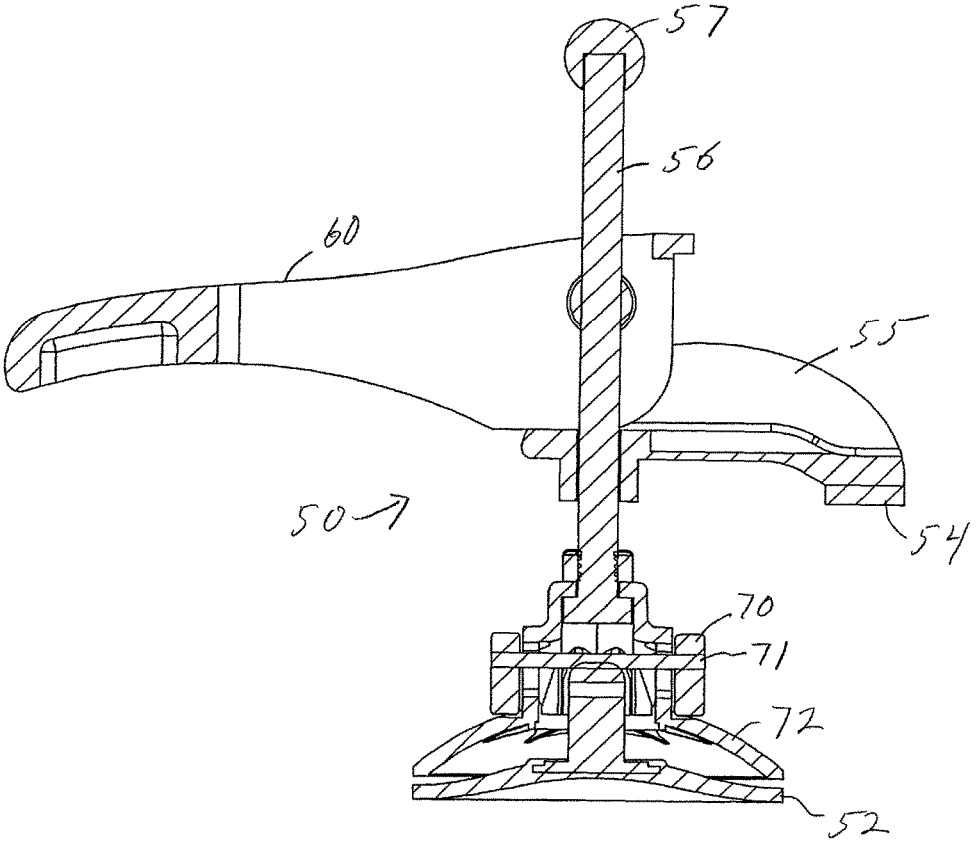
FIG. 4B is a cross-sectional view taken along line 4B-4B of FIG. 4A.

FIGS. 1A and 1B illustrate a sliding panel assembly 19 having one fixed panel unit and one sliding panel unit. The sliding panel assembly 19 is illustrated as a sliding glass door assembly and will be described as such herein although those skilled in the art will recognize that the present detachable device for inhibiting air leaks between sliding panels (also known as fastener device) 50 may be used with other sliding panel assemblies such as sliding windows. Device 50 is preferably adapted for use with panel units that have overlying frame sections when in the closed position (as in FIGS. 1A and 1B).

Fixed panel unit 20 includes a frame 21 extending about its periphery with a glass panel 22 mounted within the frame 21. Similarly, the sliding panel unit 30 includes a frame 33 extending about its periphery with a glass panel 32 mounted within the frame 33.

Fastener device 50 is configured to be removably coupled to the glass of one panel unit (e.g., glass 32) and is also configured to be tightened down against the top face of the frame of the other adjacent panel unit (e.g., frame 21). A result is that the two overlying frames 21 and 33 are pushed together, as shown by the differences between FIGS. 1A and 1B (where the frames are apart in FIG. 1A and together in FIG. 1B). This helps to inhibit the leaking of air between the overlapping frames 20 and 33.

In the first embodiment shown in FIGS. 1-4, fastener device 50 comprises suction cup 52 that can be pressed against a glass pane via pivoting cam lock 70 that acts on overlying structure 72. Cam lock 70 pivots on pin 71 that is received in structure 73. Cam lock 70 is shown in the engaged or locked (down) position in FIGS. 1-4. The disengaged/unlocked (up) position is not depicted.

Rubber contact surface 54 of arm or frame clip 55 is the structure that is configured to place pressure against a frame. This is accomplished as follows. Threaded barrel nut 61 is embedded in handle 60, and rides on threaded rod 56 with end-cap 57. With handle 60 in the up (disengaged) position, handle 60 is rotated clockwise, which causes nut 61 and thus handle 60 to move down toward the frame. This pushes frame clip 55 down toward the frame. Frame clip 55 and handle 60 are locked together so they move together by shoulder 64 overlying surface 63; see FIGS. 3 and 4A. Rotation is continued until surface 54 is close to or engages with the frame. Handle 60 is then pulled or pushed down (pivoted) toward the glass panel. This causes handle end cam surface 62 to engage with and push down against mating frame clip top surface 59. Since the frame clip is not fixed to threaded rod 56, it is pushed down, thereby placing pressure on end 54. The door or window frame under end 54 is pushed down, closer to and ideally tightly against the underlying frame of the other panel. This moves the overlapping panels (frames) 21 and 33 together and thereby reduces or seals any air leaks between the panels. See FIG. 1B. The device can be removed in the opposite manner—pull up on handle 60 to release the pressure on end 54 and turn the handle counter-clockwise to remove end 54 from the frame. Suction cup 52 can then be released by pulling up on cam lever 70.

Figure 5A:
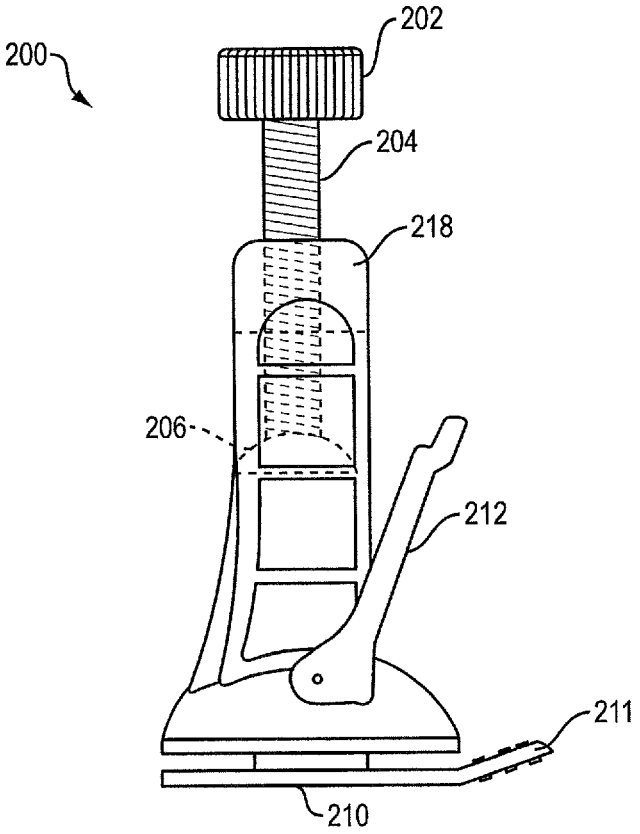
FIGS. 5A and 5B illustrate side and top perspective views, respectively, of a second example of a detachable device for inhibiting air leaks between sliding panels.
Figure 5B:
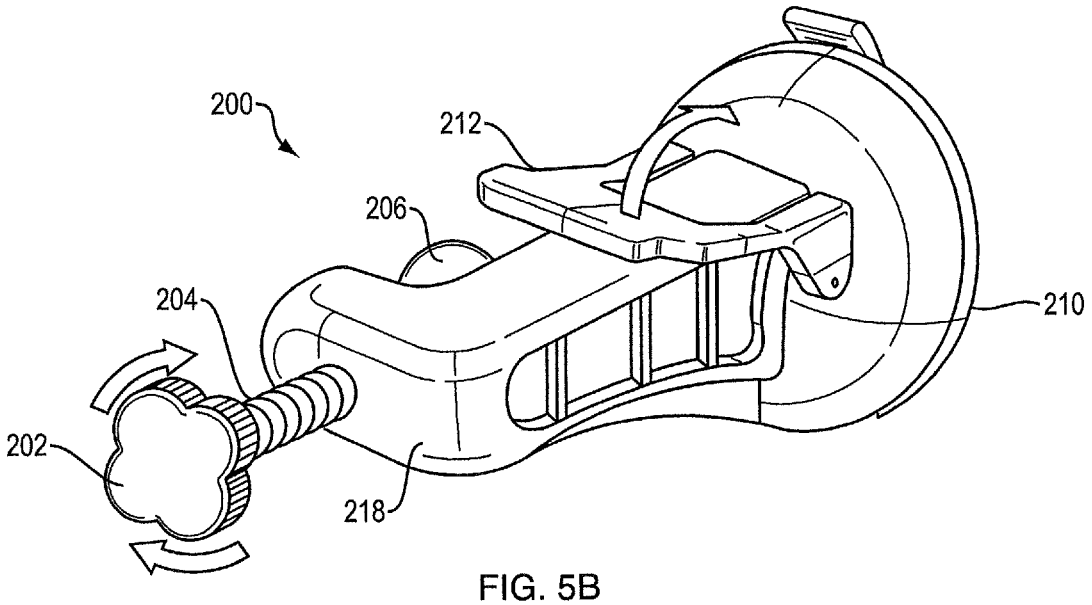

FIG. 5A illustrates a side view and FIG. 5B illustrates a perspective view of another embodiment, device 200 that also has suction cup 210 and its cam lock lever 212 for coupling to a glass pane. The coupling to the frame of the other panel in this case is via rubber foot 206 carried at the free end of threaded shaft 204 that is received in body 218 and can be rotated in two directions via knob 202. Device 200 is coupled to the slider/window by fixing suction cup 210 to the glass of one panel unit and then turning knob 202 clockwise to push foot 206 against the frame of the other panel unit, until the two frames have moved together. Device 200 can be released by turning knob 202 counter-clockwise and releasing suction cup 210 using release tab 211.

Accordingly, there is thus provided a detachable fastening device for sliding panels. The device is an effective and inexpensive mechanism to minimize air gaps common in sliding panels such as sliding glass doors and windows. Accordingly, heat transfer is advantageously minimized. For example, in cold climate regions, this can result in substantial heating cost savings as heat losses are minimized. Furthermore, the device also enables users to readily detach it so that one of the sliding panels can be moved. Also, the device does not require tools or machining any permanent attachments to existing frames.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A panel fastening device that is configured to move together a first frame of a first panel unit having a first glass panel mounted within the first frame and a second frame of a second panel unit having a second glass panel mounted within the second frame, the device comprising:

a suction cup that is configured to be coupled to and released from the first glass panel of the first panel unit; and a structure that is configured to be pressed against and released from the second frame of the second panel unit comprising a frame clip that is configured to be moved along a threaded rod by a handle that is threadably engaged with the threaded rod, wherein the handle is configured to be pivoted relative to the frame clip, and wherein the handle has a cam surface that is configured to contact a tap surface of the frame clip, such that when the handle is pivoted in a first handle pivot direction to a locked position the cam surface of the handle pushes down against the top surface of the frame clip, to push the frame clip down toward the second frame of the second unit.

2. The panel fastening device of claim l, wherein the handle has a distal end, and wherein the first handle pivot direction moves the handle distal end toward the glass panel of the first panel unit.

3. The panel fastening device of claim 2, wherein when the handle is in the locked position the handle distal end is directly over the first glass panel of the first panel unit.

4. The panel fastening device of claim 1, wherein the handle comprises a threaded nut that is engaged with the threaded rod.

5. The panel fastening device of claim 1, wherein the frame clip comprises a cushioned end face that is configured to contact the second frame of the second panel unit.

6. The panel fastening device of claim 1, further comprising a structure that is configured to release the suction cup from the first glass panel of the first panel unit.

7. The panel fastening device of claim 1, wherein the suction cup is coupled to the first glass panel of the first panel unit using a cam lock that is pivotable so as to push the suction cup against the glass.

8. The panel fastening device of claim 1, further comprising a compliant foot that is carried on a first end of the threaded rod.

9. The panel fastening device of claim 8, further comprising a knob at a second end of the threaded rod.

10. The panel fastening device of claim 9, wherein when the knob is rotated in a first direction the compliant foot is moved toward the second frame of the second panel unit.

11. The panel fastening device of claim 10, wherein when the knob is rotated in a second direction the compliant foot is moved away from the second frame of the second panel unit.

12. A panel fastening device that is configured to move together a first frame of a first panel unit having a first glass panel mounted within the first frame and a second frame of a second panel unit having a second glass panel mounted within the second frame, the device comprising:

a suction cup that is configured to be coupled to and released from the first glass panel of the first panel unit, wherein the suction cup is coupled to the first glass panel of the first panel unit using a cam lock that is pivotable so as to push the suction cup against the glass, and to release the suction cup from the first glass panel of the first panel unit; and a structure that is configured to be pressed against and released from the second frame of the second panel unit, wherein the structure that is configured to be pressed against and released from the second frame of the second panel unit comprises a frame clip that is configured to be moved along a threaded rod by a handle that is threadably engaged with the threaded rod, wherein the handle is configured to be pivoted relative to the frame clip, and wherein the handle has a cam surface that is configured to contact a top surface of the frame clip, such that when the handle is pivoted in a first handle pivot direction to a locked position, the cam surface of the handle pushes down against the top surface of the frame clip, to push the frame clip down toward the second frame of the second unit, wherein the handle has a distal end, and wherein the first handle pivot direction moves the handle distal end toward the first glass panel of the first panel unit, wherein when the handle is in the locked position the handle distal end is directly over the first glass panel of the first panel unit, wherein the handle comprises a threaded nut that is engaged with the threaded rod, wherein the frame clip comprises a cushioned end face that is configured to contact the second frame of the second panel unit.

13. The panel fastening device of claim 12, wherein the structure that is configured to be pressed against and released from the second frame of the second panel unit comprises a compliant foot, a threaded shaft that carries the compliant foot on a first end thereof, and a knob at a second end of the threaded shaft, wherein when the knob is rotated in a first direction the compliant foot is moved toward the second frame of the second panel unit and wherein when the knob is rotated in a second direction the compliant foot is moved away from the second frame of the second panel unit.

* * * * *